US005316163A

United States Patent [19]

von Schuckmann

[11] Patent Number: 5,316,163

[45] Date of Patent: May 31, 1994

[54] BOTTLE TOP HAVING INNER AND OUTER CAPS FOR SECURING AND SEALING A RESILIENT STOPPER

[75] Inventor: Alfred von Schuckmann, Kevelaer, Fed. Rep. of Germany

[73] Assignee: Pohl GmbH & Co. KG, Karlsruhe, Fed. Rep. of Germany

[21] Appl. No.: 57,285

[22] Filed: May 4, 1993

[30] Foreign Application Priority Data

Aug. 24, 1992 [DE] Fed. Rep. of Germany ..... 4228090

[51] Int. Cl.[5] ..... B65D 41/62

[52] U.S. Cl. ..... 215/249; 215/274; 215/277

[58] Field of Search ..... 215/249, 251, 254, 257, 215/258, 274, 275, 276, 277, 364

[56] References Cited

U.S. PATENT DOCUMENTS

| | | | |
|---|---|---|---|
| 3,871,545 | 3/1975 | Bereziat | 215/249 |
| 3,888,377 | 6/1975 | Stadler | 215/249 |
| 3,893,582 | 7/1975 | Kowalik | 215/274 |
| 4,093,093 | 6/1978 | Fowles et al. | 215/251 |
| 5,085,332 | 2/1992 | Gettig et al. | 215/274 |
| 5,088,612 | 2/1992 | Storar et al. | 215/249 |
| 5,143,236 | 9/1992 | Gueret | 215/276 |

FOREIGN PATENT DOCUMENTS

| | | | |
|---|---|---|---|
| 67874 | 4/1914 | Switzerland | 215/277 |

*Primary Examiner*—Allan N. Shoap
*Assistant Examiner*—S. Castellano
*Attorney, Agent, or Firm*—Sprung Horn Kramer & Woods

[57] ABSTRACT

A bottle top that comprises a tough plastic outer cap (11), a tough plastic inner cap (6) and a soft polymer stopper (4). The stopper fits inside the inner cap. The bottle has a bead (3) around its neck. The wall of the composed of several vertical strips (9). The strips are resilient radially outward and are held against the neck of the bottle by the outer cap. The bottom ends of the strips have a beveled-in edge (5) that engages the bottom edge of the bead, forcing the stopper against the upper surface of the bottle's neck. At least one area (8) of the inner cap's roof rips out. The outer cap has a hole over the rip-out area of the inner cap and screws over a thread (10) on the resilient strips that constitute the wall of the inner cap.

12 Claims, 1 Drawing Sheet

BOTTLE TOP HAVING INNER AND OUTER CAPS FOR SECURING AND SEALING A RESILIENT STOPPER

BACKGROUND OF THE INVENTION

The present invention concerns a bottle top that comprises a tough-plastic outer cap, a tough-plastic inner cap, and a soft polymer stopper. The stopper fits inside the inner cap. The bottle has a bead around its neck. The wall of the inner cap is composed of several vertical strips. The strips are resilient radially outward and are held against the neck of the bottle by the outer cap. The bottom ends of the strips have a beveled-in edge that engages the bottom edge of the bead, forcing the stopper against the upper surface of the bottle's neck. At least one area of the inner cap's roof rips out.

A bottle top of this type is known from German Published Patent Application No. OS 4 015 510. It is intended for transfusion and infusion bottles. It has a cap with a wall composed of vertical radially outwardly resilient strips that engage the bottom edge of a bead around the neck of a bottle. The cap is secured to the neck by a ring of hard plastic thrust over the cap and holding the strips in place. The cap also has locking strips that prevent removal of an outer cap. This bottle top has several drawbacks. The stopper is not forced uniformly enough against the upper surface of the bottle's neck to ensure a tight seal. The top is difficult to assemble. Discrepancies in the thickness of the bead occur that cannot be sufficiently compensated for by the beveled-in edge of the inner cap, allowing leaks from the irregular pressure of the stopper against the upper surface of the neck.

German Utility Model Patent No. GM 8 807 750 describes a plastic top for containers that are at least similar to bottles. An outer cap screws onto the inner cap, which is an integral component. The inner cap engages a bead integrated into the neck of the container. The inner cap rests against the whole circumference of the bead. The bead extends radially outward. The inner cap engages it with a claw that extends essentially radially inward. The inner and outer caps and bottle neck must be manufactured to very precise tolerances to ensure tightness, which leaves much to be desired from the aspect of manufacturing simplicity and cost. An O-ring is positioned against surface of the outer cap that faces the bottle. The O-ring comes apart at weak points when the outer cap is unscrewed from the inner cap.

Other tops are known that have a rubber stopper or disk forced against the neck of a medicine bottle by a metal cap. They are applied in two spatially separated manufacturing steps. First, the stopper is forced against the bottle in a sterile area of the plant. The full bottle is then transferred to another area, where the metal cap is applied and secured with capping machinery. The intention of such a complicated procedure is to keep particles of metal from the cap from contaminating the medicine. Another drawback of metal caps is that the ripped-out sections have dangerously rough edges. They are also complicated to dispose of because most hospitals do not have a separate aluminum-collecting point.

SUMMARY OF THE INVENTION

The object of the present invention is accordingly to provide an improvement in a bottle top of the aforesaid type whereby any impression in the separate components can be better compensated for and whereby both bottle and top will accordingly be easier and more economical to manufacture, more reliable and longer-lasting, easier to assemble, and simpler to dispose of.

This object, as well as further objects which will become apparent from the discussion that follows, are achieved, in accordance with the present invention, by providing a bottle top that comprises a tough plastic outer cap, a tough plastic inner cap and a soft polymer stopper which fits inside the inner cap. The bottle has a bead around the outside of its neck. The wall of the inner cap is composed of several vertical strips which are resilient radially outward and are held against the neck of the bottle by the outer cap. The bottom ends of the strips have a beveled-in edge that engages the bottom edge of the bead, forcing the stopper against the upper surface of the bottle's neck. At least one area of the inner cap's roof forms a rip-out section that can be pulled out by the user to expose the stopper.

The bottle top according to the invention is more reliable, longer-lasting, and easier to manufacture and apply because the outer cap has a hole over the rip-out area in the inner cap and screws over a thread on the resilient strips that constitute the wall of the inner cap. No radially outward resilient locking strips are necessary. The stopper is forced tightly enough against the neck of the bottle because the inner cap is axially tensioned toward the neck. The outer cap is initially screwed over the strips in the vicinity of the rip-out area. The strips are only slightly resilient in this vicinity. Screwing the outer cap farther onto the inner cap forces the strips radially inward toward the neck of the bottle. The beveled-in edge of the inner cap engages the bottom of the bead, forcing the stopper down onto the neck of the bottle. The force is dictated essentially by the geometries of the beveled-in edge and bead. Another advantage is that any impression, particularly in the axial tolerance of the bead, is easy to compensate for, resulting in an inexpensive but reliable seal. The top is easy to dispose of because all of its components are plastic. Once the stopper has been applied to the neck, the inner cap can be thrust over the neck until the beveled-in edges of the radially outward resilient strips engage the bottom of the bead. The top can accordingly be mounted in a sterile area and easily separated from the soft-polymer and glass components. A top of this type has a double shell. The inner shell secures the stopper to the bottle and the outer shell secures the inner shell in position. The soft-polymer stopper will be securely forced against the neck and sealed.

The inner surface of the inner cap can have a ridge around it to force the stopper against the neck. Such a ridge will increase the axial pressure enough to force the stopper tightly against the neck during the bottling process. The ridge can have a wedge-shaped cross-section, for example, and be an integral component of the inner cap.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
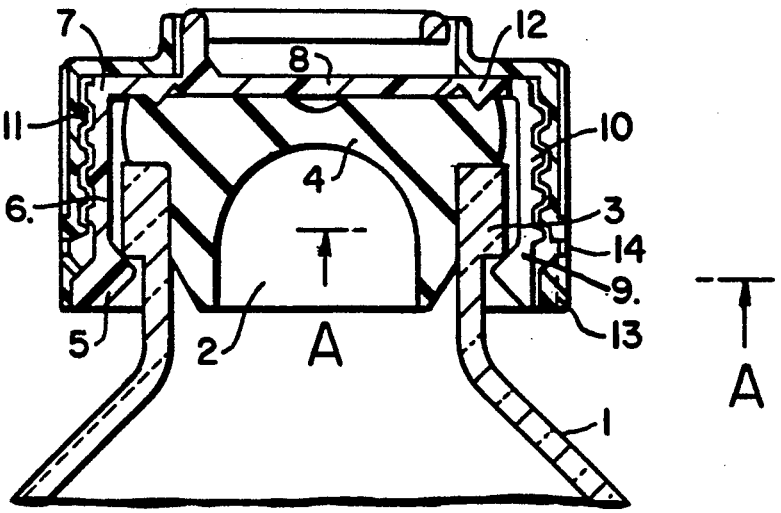
FIG. 1 is a cross-sectional view through the top of a bottle showing the bottle neck and the bottle top according to the present invention.

A stopper 4 rests on the bottle 1 illustrated in FIG. 1 and is inserted into the bottle's neck 2. The stopper is made of polymer. The bottle neck 2 is surrounded by a bead 3. The stopper 4 rests against this bead 3. A cap 6 holds the stopper 4 in place. Cap 6 is made out of a tough plastic. The wall of the cap 6 comprises several parallel elastic tongues 9 that can be sprung radially. Another cap 11 screws over an outside thread 10 on the cap 6 and holds the tongues 9 together. The two caps cooperate in forcing the stopper 4 against the neck 2 of the bottle.

The inner edge 5 of the inner cap 6 is beveled and engages the bottom edge of bead 3. In the embodiment shown, the beveled edge 5 is at an angle A, 60° in the present embodiment, with respect to the bottom of bead 3. The bottle 1 comes into contact with the inner cap 6 only along the circular interface between the beveled edge 5 and the bead 3. This feature is particularly significant with respect to equilibrating tolerances.

The roof 7 of the inner cap 6 has an area 8 that can be ripped or pulled out to allow a cannula to be introduced into bottle 1. Rip-out area 8 is situated below a hole that extends through outer cap 11.

To ensure that the stopper 4 will be forced uniformly against the neck 2 of bottle 1, the inner surface of the roof of inner cap 6 has a ridge 12 of wedge-shaped cross-section around it that is forced against the upper surface of stopper 4 by the outer cap 11.

To ensure satisfactory compensation for any imprecision in the various components, the beveled edge of the inner cap 6 is at an angle A in the range of 30° to 89° and preferably 45° to 75° with respect to the bottom of the bead 3. This feature will, in conjunction with the threaded connection between the inner and outer caps, ensure reliability even when the bottle and the various components of the top must be manufactured to relatively large tolerances.

It is of advantage for the inner cap 6 to come into contact with the bead 3 around the neck of the bottle only along the beveled edge 5. The top as a whole will accordingly center itself automatically during assembly in that it is secured to the bottle only along a circular interface. Since there will be a radial gap between the inner cap 6 and the bead 3 and since the beveled-in edge will be radially adjacent to the bead, the top will be prevented from tilting on the bottle even when economy dictates relatively large manufacturing tolerances.

Figure 2:
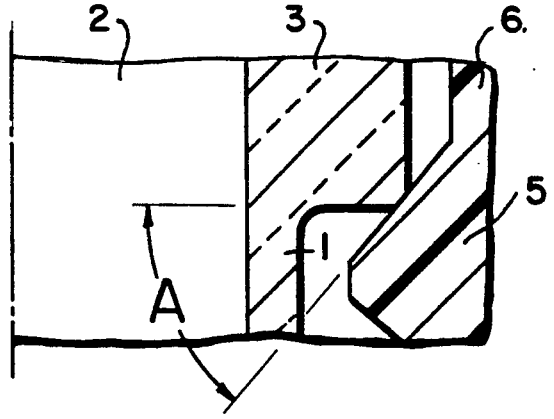
FIG. 2 is a cross-sectional view showing a portion of the bottle top of FIG. 1 in enlarged detail.

FIG. 2 is a larger-scale detail of the bottle top of FIG. 1 illustrating how only the beveled edge 5 of the inner cap 6 comes into contact with the bead 3. Angle A is again 60°.

As may be seen in FIG. 1, the inside diameter of the inner cap in the vicinity of the beveled edge is shorter than the outside diameter of the stopper. This feature keeps the stopper from tilting in the neck of the bottle and prevents irregular pressure on the stopper while the outer cap is being screwed onto the inner cap. The requisite force will derive from the threads on the inner surface of the outer cap and the outer surface of the inner cap.

Figure 3:
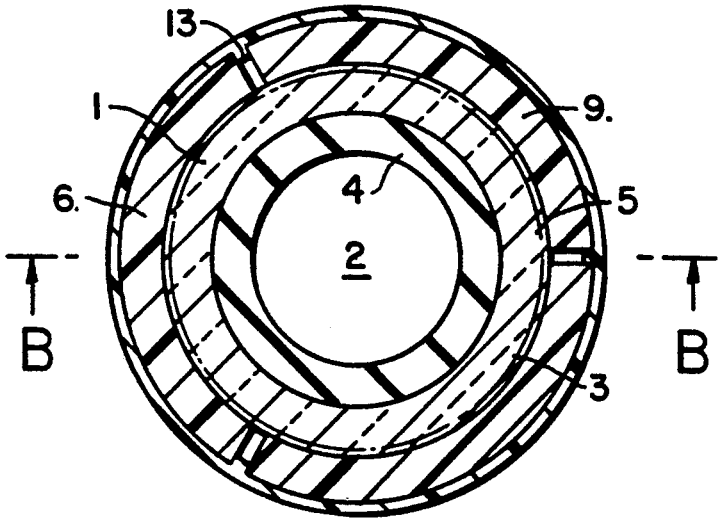
FIG. 3 is a cross-sectional view, taken along the line A—A of FIG. 1.

Depending on the particular application, the inner cap 6 can include at least three radially outward resilient tongues 9 or strips uniformly distributed around its circumference as shown in FIG. 3, and the rip-out area can have an opening tab integrated into it. Such an embodiment is particularly practical with respect to both manufacture and assembly.

The surface of the outer cap 11 that faces the radially outward resilient strips can have an antifriction coating. Such a coating will facilitate assembly and disassembly and allow extensive automation of the bottling process. The strips can be kept in position with less force. Mechanical disassembly for recycling will entail no problems.

The surface of the outer cap 11 most remote from the rip-out area has a sealing ring 13 with weakened points 14. The ring can be intercepted during assembly by barbed projections 15 on the resilient strips that cause the weakened points to shear when the outer cap is screwed off.

A bottle equipped with a top in accordance with the invention is particularly easy to recycle because the polymer stopper 4, the hard-plastic inner and outer caps 6 and 11, and the glass bottle 1 can be easily separated. Furthermore, there are no dangerous sharp aluminum edges.

There has thus been shown and described a novel bottle top which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A bottle top for a bottle having a vertical neck with an upper surface and an external circumferenctial surface which forms a bead, said bottle top comprising a tough plastic outer cap, a tough plastic inner cap, and a soft polymer stopper, wherein the stopper fits inside the inner cap, which, in turn, fits inside the outer cap; wherein the inner cap has a roof portion and a lateral circumferential portion; wherein the circumferential portion of the inner cap comprises a plurality of vertical strips that are resilient radially outward and are held against the neck of the bottle by the outer cap; wherein outer surfaces of said strips form an external thread; wherein bottom ends of said strips comprise beveled-in edges that engage the bottom edge of the bead, forcing the stopper against the upper surface of the bottle's neck; and wherein the outer cap has an internal thread that screws onto the external thread on said strips.

2. The bottle top defined in claim 1, wherein an inner surface of the inner cap has a ridge around it that forces the stopper against the neck.

3. The bottle top defined in claim 2, wherein the ridge has a wedge-shaped cross-section.

4. The bottle top defined in claim 1, wherein a minimum inside diameter of the inner cap in the vicinity of the beveled-in edges is less than a maximum outside diameter of the stopper.

5. The bottle top defined in claim 4, wherein the beveled-in edges are at an angle in the range of 30° to 89° to the bottom of the bead.

6. The bottle top defined in claim 5, wherein the beveled-in edges are at an angle in the range of 45° to 75° to the bottom of the bead.

7. The bottle top defined claim 1, wherein the inner cap comes into contact with the bead around the neck of the bottle only along the beveled-in edges.

8. The bottle top defined in claim 1, wherein the inner cap includes at least three of said strips uniformly distributed around its circumference.

9. The bottle top defined in claim 1, wherein the surface of the outer cap that faces the radially outward resilient strips has an antifriction coating.

10. The bottle top defined in claim 1, wherein the bottom portion of the outer cap forms a sealing ring with weakened points.

11. The bottle top defined in claim 1, wherein a roof area of the inner cap is constructed to be ripped out by a user, and wherein the outer cap has a hole over the rip-out area of the inner cap.

12. The bottle top defined in claim 11, wherein the rip-out area has an open tab integrated into it.

* * * * *